United States Patent [19]

Shaw

[11] 4,375,156

[45] Mar. 1, 1983

[54] CLOSED LOOP COMPRESSED GAS SYSTEM WITH OIL MIST LUBRICATED SCREW COMPRESSOR

[75] Inventor: David N. Shaw, Unionville, Conn.

[73] Assignee: Dunham-Bush, Inc., West Hartford, Conn.

[21] Appl. No.: 193,496

[22] Filed: Oct. 3, 1980

[51] Int. Cl.[3] ..... F25B 41/00; F04C 18/16; F04C 29/02

[52] U.S. Cl. ..... 62/468; 418/97; 418/102; 418/201

[58] Field of Search ..... 418/102, 201, 97, 99; 62/468, 473

[56] References Cited

U.S. PATENT DOCUMENTS

| | | | |
|---|---|---|---|
| 2,384,872 | 9/1945 | Baker et al. | 418/102 |
| 3,063,378 | 11/1962 | Hart | 418/102 |
| 3,156,191 | 11/1964 | Lauck | 418/102 |
| 3,796,526 | 3/1974 | Cawley | 418/201 |
| 3,885,402 | 5/1975 | Moody, Jr. et al. | 418/201 |
| 3,899,271 | 8/1975 | Glanvall | 418/102 |
| 3,927,956 | 12/1975 | Linthicum | 418/102 |
| 4,311,021 | 1/1982 | Leo | 62/468 |

FOREIGN PATENT DOCUMENTS

| | | | |
|---|---|---|---|
| 2003868 | 8/1971 | Fed. Rep. of Germany | 418/102 |
| 131272 | 6/1978 | German Democratic Rep. | 418/102 |

*Primary Examiner*—John J. Vrablik

*Attorney, Agent, or Firm*—Sughrue, Mion, Zinn, Macpeak & Seas

[57] ABSTRACT

A rotary helical screw compressor for a refrigeration system employing a condensable refrigerant comprises intermeshed rotors mounted for rotation by way of anti-friction bearings, within a hermetic housing. A lubricating oil miscible in liquid refrigerant is supplied to the compressor in a mass ratio of between 0.25 and 12%, by weight of solution. Vaporized working fluid at discharge pressure and bearing oil mist is permitted to seep through the anti-friction bearings in closed loops, from the discharge side of the machine towards the suction side, for effective lubrication. Thus, the refrigeration system is oil pump free, oil sump free, and oil filter free. Liquid refrigerant oil solution may be bled from the condenser and injected into the compression chamber defined partially by the intermeshed rotors at a point in the compression process where the compression chamber is cut off from suction and discharge sides of the compressor, for cooling the rotors.

4 Claims, 1 Drawing Figure

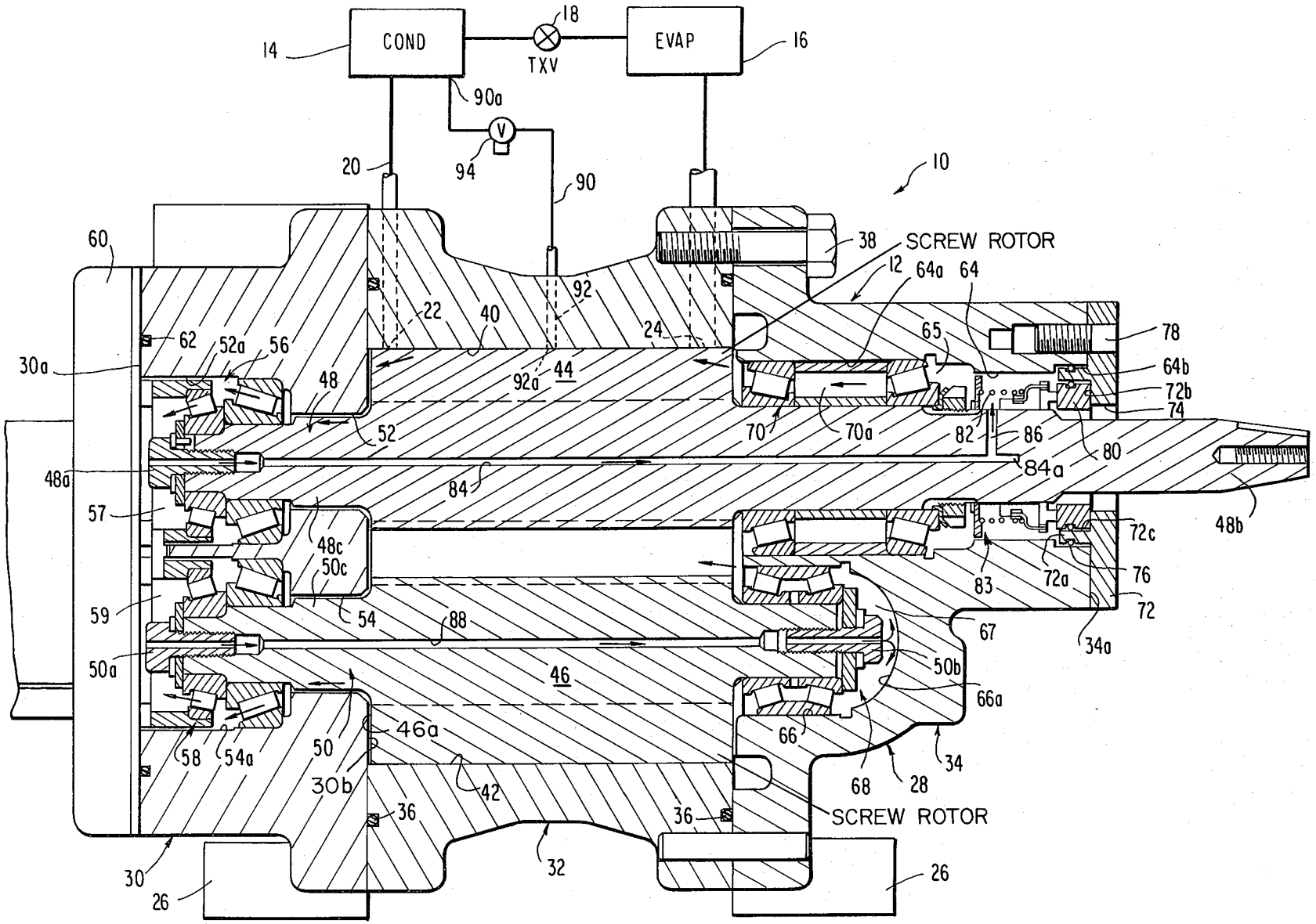
EVAP
TXV
COND
SCREW ROTOR
SCREW ROTOR

CLOSED LOOP COMPRESSED GAS SYSTEM WITH OIL MIST LUBRICATED SCREW COMPRESSOR

FIELD OF THE INVENTION

This invention relates to closed loop compressed gas systems using hermetic, rotary helical screw compressors of the type set forth in U.S. Pat. No. 4,181,474 issued Jan. 1, 1980, and assigned to the common assignee.

DESCRIPTION OF THE PRIOR ART

Hermetic, rotary helical screw compressors have evolved, particularly in the low horsepower sizes, as unitary pieces of equipment. Some compressions employ, within the hermetic housing, means for separating lubrication oil used in the lubrication of the moving parts from the working fluid. The rotary helical screw compressor may operate with the intermeshed rotors rotating about parallel vertical axes. An electrical drive motor may be carried within the housing and with its rotor fixed to one of the screw rotors for directly driving the same and indirectly driving the intermeshed adjacent rotor.

The above indentified patent illustrates an improved vertical axis rotary helical screw compressor, particularly useful in refrigeration systems, which employs upper and lower anti-friction bearing pack assemblies for rotatably supporting the parallel axis intermeshed helical screw rotors, with the antifriction pack bearing assemblies functioning to take up both radial and axial forces developed during the compression process and acting on the screw rotor shafts. The hermetic compressor is characterized by the utilization of the hermetic housing itself as an oil sump, and a mass of lubricating oil fills the bottom of the housing functioning as that sump. Additionally, since the hermetic compressor employs an overlying compressor electric drive motor for driving the intermeshed rotors and utilizes the compressor working fluid at discharge pressure for cooling that motor, oil entrained in the working fluid in vapor form tends to seep back through the antifriction bearing structure surrounding the shaft at the upper ends of the intermeshed helical screw rotors for lubricating those antifriction bearings seeking the suction side of the machine. Oil entrainment occurs in the suction return from the refrigeration system evaporator to the intermeshed helical screw rotors for compression within the compressor working chamber.

This hermetic compressor structure eliminates the necessity for a separate oil pump for pressurized feed of separated lubricating oil to the bearing structure supporting the rotor shafts for rotation about their axes. While the vertical orientation of the compressor rotors along with the utilization of discharge pressure acting axially through the upper bearing structure on the intermeshed helical screw rotors functions, along with the weight of the screw rotors themselves and the hermetic motor rotor, to balance out the axial forces resulting from the compression process on the working fluid, the hermetic compressor is still burdened with the requirement for an oil sump, an oil filter, and in the referred to patent, an oil injection mechanism for directly injecting oil into the intermeshed screws at the suction side of the machine.

Within recent years, to limit the discharge temperature of a compressible gas such as a refrigerant which is superheated during the work of compression by a helical screw compressor, a vaporizable liquid is injected into the gas within the compression chamber and closed off to the suction and discharge sides of the helical screw compressor, for limiting the compressor discharge temperature. The desirability of controlling and limiting discharge temperature lies in preventing dangerous temperature levels from being reached which may injure the components of the compressor or the lubricant to the compressor, thereby shortening the useful lives of the components.

U.S. Pat. No. 3,795,117 entitled "Injection Cooling of Screw Compressors" to Harold W. Moody, Jr. et al and assigned to the common assignee, employs a liquid refrigerant bled from a condenser at near compressor discharge pressure and injected, either through a fixed port, or a port carried by a longitudinally adjustable slide valve, directly into the compression chamber defined by the slide valve and/or the compressor rotor housing and the intermeshed helical screw rotors. Oil entrained within the liquid refrigerant functions in part to seal the rotor tips and thus the compression chamber as defined by the intermeshed rotors and the the rotor housing. Additionally, the patent teaches the utilization of a separate lubricating oil injection port which may be borne commonly by the slide valve to insure the sealing of the working chamber at the rotor tips.

It is, therefore, an object of the present invention to provide an improved rotary helical screw compressor of the hermetic type which utilizes the miscibility between oil and a condensible gas or vaporous working fluid such as a refrigerant in terms of a defined mass ratio between the working fluid and the lubricating oil for oil mist lubrication of the compressor anti-friction bearing thereby eliminating the necessity of an oil sump, oil pump and filter, normally employed in such hermetic compressors.

It is a further object of the present invention to utilize liquid refrigerant injection within such antifriction bearing type hermetic compressor for insured cooling of the compressor rotary components to eliminate dangerously high temperatures during the compression process, while insuring sealability of the helical screw rotor tips relative to the rotor housing components.

SUMMARY OF THE INVENTION

A hermetic rotary helical screw compressor for use in a compressed gas closed circulation loop comprises a closed cylindrical enclosure and parallel intersecting bore means formed within the casing mounting respective intermeshed helical screw rotors and forming therebetween, a compressor working chamber. The helical screw rotors including axially extending shaft means for rotatively mounting said helical screw rotors for rotation about the shaft axes within housing borne antifriction bearings. A suction port opening to the casing bore means at one end, is connected to said closed gas circulation loop for supplying the working fluid in gaseous form to the compressor working chamber at relatively low pressure for compression of the working fluid within the compressor working chamber by rotation of the intermeshed screw rotors. A discharge port opening to the casing bore means at the opposite end of the compression chamber and connected to the other end of the closed loop supplies compressed working fluid to the loop at a relatively high pressure. The improvement resides in a predetermined ratio of a lubricant to working fluid which is atomized in the gaseous working fluid, and carried thereby from the inlet to the outlet in mist form. Means define a low volume working fluid transport loop between the anti-friction bearing assemblies and through the intermeshed helical screw rotors to effect mist lubrication of the sealed bearing assemblies and sealing of the helical screw rotors within the bores under a pressure differential between the suction and discharge ports of the helical screw compressor. This eliminates the necessity for a compressor bore an oil sump and an oil separator and pump for pumping the oil to the bearing assemblies.

Preferably, radial passages are provided near one end of the shaft means for respective helical screw rotors which open to the interior of a sealed bearing assembly and communicate by way of a small diameter axial bore within a helical screw rotor shaft to complete the limited volume gas loop between the bearing assemblies, through the intermeshed helical screw rotors and the housing bores.

The rotary helical screw compressor, when incorporated within a low pressure refrigerant closed loop refrigerant circuit, may function adequately without liquid refrigerant injection into the compression chamber as defined by the intermeshed helical screw rotors. However, where the closed loop refrigerant circuit includes a condenser and evaporator in that order from the compressor discharge port to the suction port, means may be provided for bleeding some of the condensed liquid refrigerant from the condenser and injecting it in liquid form through an injection port opening to one of the bores bearing the intermeshed rotors to facilitate cooling of the refrigerant working fluid within the compression chamber. The closed loop gaseous working fluid, when constituted by a refrigerant, may comprise R12 or R22 refrigerant. The working fluid may comprise helium with the compressor operating at suction and discharge pressures in which the helium is desuperheated but not condensed. A conventional commercial grade oil petroleum based lubricating oil may constitute the lubricant. The mass ratio of a miscible petroleum based lubricant to the gaseous working fluid ranges from approximately 0.25 to 12% by weight of solution.

BRIEF DESCRIPTION OF THE DRAWING

The single FIGURE is a partial schematic, partial longitudinal sectional view of a closed loop, low pressure refrigerant circuit incorporating within the loop, an oil mist lubricated rotary helical screw compressor forming a preferred embodiment of the present invention.

DESCRIPTION OF THE PREFERRED EMBODIMENT

Referring to the FIGURE, while the present invention is applicable to any compressed gas closed loop recirculation system employing a rotary helical screw compressor as the means for forced flow of a gas through the loop from the high pressure, discharge port of the compressor to the low pressure, suction port of that compressor. The improved compressor of the present invention may be employed within a closed loop refrigeration circuit in which a low pressure refrigerant such as R12, functions as the working fluid. Alternatively, the working fluid may comprise R22 refrigerant, or helium. The helium may be noncondensible at the pressures provided by the compressor and the gas passes through the loop from the high pressure discharge side of the compressor to the lower pressure suction side, under desuperheated but none condensed condition.

The closed loop refrigeration system indicated generally at 10, comprises, in order, a hermetic rotary helical compressor indicated generally at 12, a condenser 14, and an evaporator 16. In conventional manner, a thermal expansion valve indicated generally at 18 is provided within the loop at the inlet side of the evaporator 16. Tubing or piping 20 functions to connect the discharge port 22 of compressor 12 to the inlet side of condenser 14, the outlet side of the condenser 14 to the inlet side of the evaporator 16, at TXV valve 18, and the outlet side of the evaporator 16 to the suction port 24 of the compressor.

While the rotary helical screw compressor of the present invention may be of the form illustrated, it could be of a modified form appearing within the referred to U.S. Pat. No. 4,181,474, that is, a hermetic rotary helical screw compressor, wherein an electric drive motor is carried internally within the housing. However, the compressor of that patent would have to be modified such that the oil separation function of the electric drive motor and that of the overlying dish type deflector is eliminated. In that case, the lower half of the housing would not function as an oil sump and the refrigerant loop incorporating the compressor would have both the connections to the suction port of the compressor and the discharge port isolated from the housing interior. Further, the refrigerant working fluid would be required to have a highly miscible lubricating oil provided to that working fluid for the system within the critical mass ratio requirements of this invention.

In the environment of use illustrated, the closed loop compressed gas system employs a conventional low pressure refrigerant such as R12, and the compressor 12 comprises a horizontal axis compressor of relatively small capacity, vehicle mounted within a multi-passenger bus, for example, with the compressor being driven by the vehicle engine. In that respect, the compressor 12 is mounted to the engine housing (not shown) by mounting pads 26. The pads support a sectional hermetic casing or housing indicated generally at 28, including three axially abutting housing or casing sections; a high pressure casing or housing section 30 of generally cylindrical form, a central casing or housing section 32 also of cylindrical form and a low pressure suction or casing housing section 34 of modified cylindrical form. The cylindrical compressor housing sections are in end to end abutting contact are being sealed by way of annular O-ring seals 36 borne by opposed ends of the central section 32 which abuts correspondingly opposed radial faces of housing sections 30 and 34. The housing sections may be bolted together by bolts or the like as indicated at 38.

The central housing section 32 includes a pair of internal, cylindrical, intersecting bores as at 40 and 42 which rotatably carry intermeshed helical screw rotors 44 and 46, respectively. The intermeshed helical screw rotors are integrally formed with drive shafts as at 48 and 50, respectively, for helical screw rotors 44 and 46. The high pressure discharge housing section 30 carries a first bore 52 sized to shaft 48, at the end of rotor 44, and a second bore 54 sized to shaft 50 within which portions of these shafts project for rotation therein. Bore 52 is counterbored at **52*a*, and bore 54 is counterbored at 54*a*. Counterbores 52*a* and 54*a*, respectively form cavities or chambers 57, 59 for receiving and mounting high pressure or discharge side, antifriction bearing assemblies indicated generally at 56 and 58, respectively, for one end of shafts 50 and 52. The counterbores 52***a* and 54*a* open to axial end wall 30*a* of housing section 30, across which spans a circular end plate 60. End plate is bolted to, or otherwise affixed to end face 30*a* of housing section 30. An O-ring seal 62 is mounted within an annular groove within the end face 30*a* so as to seal that end of the hermetic compressor housing 28. At the opposite end of the compressor, housing section 34 is provided with a first bore 64 for receiving the other end of shaft 48, the bore 64 being counterbored at 64*a* axially internally of bore 64 towards the helical screw rotor 44 borne by shaft 48.

Further, the casing or housing section 34 is provided with a second bore 66 which receives the projecting end of shaft 50, to the right of screw rotor 46. Bore 66 extends only through a portion of the cylindrical housing section 34 and terminates in a dome shaped wall 66*a* defined by the the bottom of bore 66. The bore 66 defines a cylindrical cavity or chamber 67, within which is mounted a first suction side or low pressure antifriction bearing pack assembly 68. Mounted within a cavity or chamber 65 defined by counterbore 64*a*, and between that casing 34 and shaft 48, is a second suction side or low pressure antifriction bearing pack assembly indicated generally at 70, this bearing pack assembly including at 70*a* a labyrinth seal structurally similar to the labyrinth seals employed in U.S. Pat. No. 4,181,474 previously referred to. The axial end face 34*a* of housing section 34, which is remote from the end of that housing section facing the helical screw rotors 44 and 46, bears an annular end plate 72 which includes an annular, axial projection 72*a* which projects within a further, small counterbore 64*b* of the housing section 34, radially remote from shaft 48. Shaft 48 projects through an enlarged diameter circular opening or axial hole 74 within end plate 72. The annular projection 72*a* bears a peripheral recess within its radially outboard face which carries an O-ring seal 76. The end plate 72 may be bolted or screw-mounted to housing section 34 by a series of bolts or screws 78. The annular projection 72*a* forms a radial shoulder as at 72*b*, via a peripheral recess 72*c*, which recess 72*c* carries a ring 80 having an inner diameter which is larger than the diameter of shaft 48, which projects through ring 80. Ring 80 bears a coil spring 82 which presses axially on a seal assembly indicated generally at 83 which seals off the suction side antifriction bearing pack assembly 70 to the atmosphere exterior of the hermetic compressor. This seal assembly 84 is in addition to the labyrinth seal 70*a* of the antifriction bearing pack assembly 70.

With respect to the bearing pack assemblies, they comprise, in a preferred form, tapered roller bearings (two in number) and function to take up the both thrust forces and radial forces acting through the shaft onto the stationary components of the machine, particularly the housing components 30, 32 and 34. As an example, anti-friction bearing pack assembly 56 comprises two sets of tapered roller bearings mounted for rotation about their axes and being held between appropriate radially inner and outer roller bearing cages. The nature and assembly of the antifriction bearing pack assemblies may be readily ascertained by more detailed reference to issued U.S. Pat. No. 4,181,474, and may be identical thereto.

Further, by reference to U.S. Pat. No. 4,181,474, it may be appreciated that, since some clearance must exist between the rotating elements of the compressor and the stationary elements, the compressed gas working fluid may flow between the spaced rotating and stationary elements determined by the pressure differential which exists between the suction side of the machine, as defined by suction port 24, and the discharge side of the machine, as defined by discharge port 20. The present invention utilizes the small volume or rate of flow of such working fluid in gas or vapor form to carry the miscible lubricant in mist form to the components requiring lubrication. Further, the miscible oil within the main stream of working fluid passing through the compression chamber as defined by the intermeshed screw rotors 44, 46 and the housing bores 40 and 42 within the compressor central housing central section 32, functions to provide the sealability between the tips of the helical screw rotor vanes formed on respective rotors, in the area of their contact with each other and with the housing bores during rotation of the rotors 44, 46 on respective rotor shafts 48 and 50.

Further, the present invention, in a preferred form, makes use of small diameter axial flow passages within the shafts themselves and opening to the cavities housing the antifriction bearing pack assemblies at respective ends of the shafts 48 and 50 to effect the distribution of the oil mist carried by the working fluid to these bearing pack assemblies, via closed loops. This movement is effected by the pressure differential existing on the working fluid between the suction and discharge sides of the machine.

Specifically, the shaft 48 is provided with a fine or small diameter axial bore 84 which extends from left end 48*a* of the shaft 48 towards its opposite, right end 48*b*. End 48*b* is shown as being splined to permit connection to a shaft drive mechanism (not shown) and preferably consisting of a drive element either directly or indirectly driven by the bus propulsion engine. Bore 84 terminates at 84*a* at an axial point beyond the end of the antifriction bearing pack assembly 70, remote from the suction port 24 and therefore remote from the compression chamber. One or more radial passages, as at 86, open from the axial bore 84 to the exterior of the shaft 48 and to chamber 65 housing the antifriction bearing pack assembly 70. The opposite end 48*a* of the shaft is spaced from end plate 60 such that the bore 84 opens axially to chamber 57 housing the antifriction bearing pack assembly 56 at the discharge and of the compressor. Further, shaft 48 includes an axially extending portion 48*c* which is of a diameter slightly less than that of bore 52 within housing section 30, through which this portion of the shaft passes, so that the working fluid, at compressor discharge pressure, may leak to chamber or cavity 57 housing the antifriction bearing pack assembly 56. As may be appreciated, the intersecting bores 40 and 42 function along with the cavities or chambers 65 and 57 as well as axial bore 84 and radial passage 86 within shaft 48, to form a limited volume, closed loop passage for working fluid bearing the lubricating oil in mist form. The working fluid leaked to that loop circulates purely as a result of the pressure differential between the suction and discharge sides of the helical screw compressor.

For rotor 48, enmeshed with rotor 44, a very similar arrangement is provided to form a second closed loop circulation path for a limited volume or flow rate of the working fluid bearing the oil in mist form. Specifically, the shorter axial length shaft 50 bears a small diameter axial bore 88 from end face 50*a*, the full length of this shaft, to opposite end face 50*b*. End face 50*a* of shaft 50 is spaced axially some distance from the end plate 60 such that the small diameter bore 88 of shaft 50 opens to chamber or cavity 59 bearing the antifriction bearing pack assembly 58. End face 50*b* of shaft 50 is spaced somewhat from the bore end wall 66*a* of housing section 34. Thus, the axial bore 88 of shaft 50 opens to cavity or chamber 67 housing the anti-friction bearing pack assembly 68, at the suction side of the helical screw rotor 46, borne by shaft 50. Further, the shaft 50 is provided with an axially extending shaft portion 50*c*, from the high pressure or discharge end face 46*a* of rotor 46. End face 46*a* is spaced axially, slightly from end face 30*b* of housing section 30, such that some high pressure working fluid seeps through the gap, particularly between bore 54 of casing section 30 and the shaft portion 50*c* to enter the chamber or cavity 59 bearing the antifriction bearing pack assembly 58.

Thus, there is formed a similar low volume/low flow rate, closed circulation loop for the bled working fluid bearing the lubricating oil in mist form. Due to the pressure differential caused by the compression process, oil in mist form circulates from the discharge end of compression chamber through the sealed chamber or cavity housing the antifriction bearing pack assembly 58, shaft axial bore 88 and through cavity 69 housing antifriction bearing pack assembly 68 back to the suction side of the machine as defined by end face 46*b* of the helical screw rotor 46. The arrows within the single FIGURE illustrate the flow of oil mist laden compressor working fluid and in the illustrated embodiment, the refrigerant R12 in vapor form to lubricate the compressor moving parts, particularly the antifriction bearing pack assemblies for both screw rotors shafts.

Where as in the instant case the compressor is functioning to compressor low pressure refrigerant for use in a bus air conditioning system, there is no need to counterbalance the thrust developed during compression of the working fluid within the compression chamber as defined by the intermeshed helical screw rotors 44 and 46, that is, a thrust which would tend to force the rotor structure to shift axially from left to right in the FIGURE. There is, however, a requirement that the lubricant or oil provided to the working fluid in mist form be nearly 100% miscible with the compressed working fluid at the high side of the machine, that is, on the side of the machine open to the discharge port 22. Further, as may be appreciated, it is necessary that the compressor function within a closed loop recirculation system where there is a 100% return of working fluid. Otherwise, the system would be expensive and the oil or like lubricant in mist form which is lost to the compressor would have to be resupplied as needed. Further, it must be appreciated that the oil in mist form provides degradation of the heat transfer function at condenser 10 and evaporator 16. However, this is counterbalanced by the elimination of the necessity for an oil separator, a positive pressure oil pump for providing the necessary pressure for the oil to lubricate the bearing structure of the compressor, the necessity for an oil separator to separate the oil from the working fluid prior to feeding the oil free refrigerant or other gaseous working fluid to components such as a condenser or an evaporator performing a heat transfer function within the closed loop system to which the invention has application. As indicated previously, the lubricant may be provided in terms of low mass ratio to a refrigerant such as R12 and at a higher mass ratio to a refrigerant such as R22. The oil may comprise any suitable petroleum based lubricant or synthetic lubricant functioning equivalently as long as the lubricant is adequate to seal the rotors and to lubricate the bearings of the compressor. The lubricant may a commercial oil based lubricant such as that manufactured by the Sun Oil Company and sold under their trademark SUNISCO 5G. The mass weight ratio of lubricating oil to the compressor working fluid in gaseous or vapor form is from approximately 0.25 to 12%. Additionally, while the invention has been described in conjunction with a refrigerant which constitutes a readily condensible vaporous or gaseous working fluid, a refrigerant such as helium may be employed in which the helium acts essentially as a noncondensable gas and being desuperated downstream of the compressor prior to return to the compressor at the suction side thereof, but in which, the helium is not condensed to liquid form.

The illustrated embodiment of the invention shows an improved oil sump, oil separator and oil pump free compressor within a closed loop system wherein the working fluid comprises a suitable refrigerant and wherein means are provided for bleeding a low volume and low flow rate liquid refrigerant from condenser 14 by way of bleed line 90 which has one end at 90*a* connected to the condenser and the other end as at 90*b* connected to a radial passage 92 within housing section 32. Passage 92 defines a liquid refrigerant injection port 92*a* opening to the one of the bores such as bore 40 at a point shut off from the suction and discharge sides of the machine. By opening to the compressor working chamber, flashing of the liquid refrigerant functions to cool the working fluid during the compression process. A suitable control valve 94 is provided within line 90 which may be solenoid operated and connected to a temperature and/or pressure sensor located (not shown) within the refrigerant system for controlling the rate of liquid refrigerant injection, in proportion to system load or the like. With some oil within the refrigerant, the liquid refrigerant injected into the compression chamber by way of injection port 92 mixes readily with the refrigerant vapor from suction bearing the lubricant in mist form. The oil readily seals the rotor tips to enhance compression.

While the invention has been particularly shown and described with reference to a preferred embodiment thereof, it will be understood by those skilled in the art that various changes in form and details may be made therein without departing from the spirit and scope of the invention.

What is claimed is:

1. In a closed loop compressed gas system including a rotary helical screw compressor having a low pressure suction port and a high pressure discharge port and closed loop means connecting said hermetic helical screw compressor discharge and suction ports and for continuously circulating a working fluid in gaseous or vapor form between said ports by way of said closed loop means through said helical screw compressor by a pressure difference due to compression within said compressor, and wherein said compressor comprises: a hermetic housing, intersecting parallel bores within said hermetic housing, shaft borne helical screw rotors intermeshed and mounted within respective intersecting parallel bores for rotation about respective shaft axes, and defining with said housing bores a compression chamber and being open at one end to said loop means via said suction port and at the other end to said loop means via said discharge port, sealed antifirction bearing means borne by said housing for solely rotatably supporting the helical screw rotor shaft to opposite sides of said helical screw rotor and for solely taking up radial and axial thrust forces acting therein, and wherein said hermetic compressor housing and said helical screw rotor shafts define sealed chambers at respective ends of said helical screw rotors which bear antifriction bearing pack assemblies constituting said antifriction bearing means, the improvement wherein:

said closed loop system includes within said closed loop means a working fluid in gaseous or vapor form bearing a petroleum based lubricant in oil mist form having a mass weight ratio with respect to said working fluid being approximately 0.25 to 12% by weight and wherein said compressor further comprises closed loop lubricating passage means including said compression chamber and said sealed chambers housing said antifriction bearing means, passage means connecting respective sealed chambers on opposite sides of said helical screw rotors bearing said antifriction bearing pack assemblies, and discrete gaps between said rotary shaft, said helical screw rotors and said compressor housing such that the miscible oil, in mist form, is carried by the working fluid moving continuously through the working chamber and the sealed chambers bearing the anti-friction bearing pack assemblies and said closed loop lubricating passage means by working fluid compression pressure differential to facilitate oil mist lubrication of respective bearing pack assemblies, thereby eliminating the need for an oil pump, an oil sump and an oil separator.

2. The closed loop continuous flow compressed gas system as claimed in claim 1, wherein said closed loop lubricating passage means between said antifriction bearing means comprise passage means within said shafts leading to respective sealed chambers on opposite sides of the helical screw rotors bearing said antifriction bearing pack assemblies.

3. The closed loop continuous flow compressed gas system as claimed in claim 1, wherein said shafts each comprise small diameter axial bores forming part of said closed loop lubricating passage means and at least one of said shafts includes radial passage means from said axial bore to the peripheral surface of the shaft and opening into one of the sealed chambers bearing said antifriction bearing pack assemblies.

4. The closed loop continuous flow compressed gas system as claimed in claim 1, wherein said working fluid comprises a condensible refrigerant, and said system further comprises a condenser and evaporator in series with the compressor and in that order, and wherein a bleed line coupled to the condenser at one end and opening to the compressor working chamber, at one of said bores housing said intermeshed screw rotors at the other end thereof, permits refrigerant working fluid in liquid form to be injected into the compressor working chamber intermediate of said suction and discharge ports for cooling of the working fluid during the compression process and wherein miscible oil carried therein is entrained within working fluid in vapor form passing through the working chamber and being subject to the compression process.

* * * * *